United States Patent [19]

Cervantes

[11] Patent Number: 4,824,109

[45] Date of Patent: Apr. 25, 1989

[54] PORTABLE ELECTRONIC BOWLING SCORING DEVICE

[76] Inventor: Adan R. Cervantes, 6547 N. Academy, Ste. 451, Colorado Springs, Colo. 80907

[21] Appl. No.: 779,154

[22] Filed: Sep. 23, 1985

[51] Int. Cl.[4] ..... A63D 5/04

[52] U.S. Cl. ..... 273/54 C; 340/323 B; 364/411

[58] Field of Search ..... 273/37, 54 C, 1 ES, 273/1 GC, 1 GE, 85 G; 340/323 B; 434/249, 252; 364/411

[56] References Cited

U.S. PATENT DOCUMENTS

| | | | |
|---|---|---|---|
| Re. 28,503 | 8/1975 | Townsend et al. | 273/54 C |
| 3,738,652 | 6/1973 | Reynolds | 273/54 C |
| 3,858,198 | 12/1974 | Ross | 273/54 C X |
| 4,092,727 | 5/1978 | Warner | 273/54 C X |
| 4,225,924 | 9/1980 | Trujillo | 273/54 C |
| 4,582,322 | 4/1986 | Yokoi et al. | 273/1 GE |
| 4,607,843 | 8/1986 | Signoretti | 273/54 C |
| 4,654,650 | 3/1987 | Fadem | 340/72 G |

*Primary Examiner*—Maryann Lastova

*Attorney, Agent, or Firm*—Timothy J. Martin; J. Preston Oxenham

[57] ABSTRACT

A computerized bowling device includes a microprocessor, logic and memory that drives a novel display panel. The display panel has a name display region for showing a team's name or a bowler's name and a plurality of primary regions and a final frame region to display the running score of a bowler. Each of the primary regions has separate first and second ball registries, with the second ball registries having an X-shaped symbol, a subtotal region for displaying a subtotal score, a frame active indicator for indexing an addressed frame and a ball registry indicator for indexing an addressed register. The final frame region is similar to the primary frame region but includes a plurality of ball registers having numeric symbols and a plurality of registers having X-shaped symbols. The computer receives data and commands from a keyboard to cause tabulation and display of bowling scores, and can keep several running scores in memory while a different score is displayed, this being accomplished through a bowler scroll command key. Errors can be corrected at the time made or subsequently, with the computer automatically updating corrected subsequent totals. A printer and a tape storage may be used to generate a hard copy of the running scores.

23 Claims, 7 Drawing Sheets

PORTABLE ELECTRONIC BOWLING SCORING DEVICE

BACKGROUND OF THE INVENTION

The present invention relates to an electronic apparatus adapted for scoring the popular sport of bowling, and is particularly adapted to be constructed as a relatively inexpensive, portable unit which may be either provided by the bowling establishment or which may be owned by an individual player. Accordingly, this invention relates to an apparatus that allows the progressive computing, registering and printing of scores for a plurality of bowlers in such a manner that it may be used for individual, group or team scoring. As such, it is constructed to comply with the requirements of bowling federations, such as the American Rubberband Duckpin Bowling Congress and the like.

The most common system used for scoring bowling employs a specially printed sheet on which bowlers progressively mark their performance. Here, either a player or a scorekeeper records by hand the pin fall for each ball rolled by the players and mentally computes a running score for each player, which score is recorded on a frame-by-frame basis. While this system is generally acceptable, it is nonetheless cumbersome and may be subject to arithmetic errors on the part of the scorekeeper, especially in the excitement generated in this fast-moving and dynamic game. Indeed, many players do not enjoy the regimen required by manual scorekeeping.

Attempts have been made in the past to provide computerized scorekeeping systems for bowling establishments wherein video CRT displays are provided for each bowling lane. One such system, described in U.S. Pat. No. 4,302,010, issued 24 Nov. 1981 to Kaeneal includes a central manager's console linked in parallel to a plurality of lane score processors each having CRT display monitor units. This system employs a complete alpha-numeric keyboard along with a series of command keys for each lane, and a local CRT displays information relative to the players' performances on that lane. A manager's console monitors each of the lanes and can override the displays it desires.

U.S. Pat. No. 4,225,924 issued 30 Sept. 1980 to Trujillo shows a more simplified electronic bowling score that utilizes a reduced number of data entry keys and relies more on user friendly software for data entry. U.S. Pat. No. 3,931,966 issued 13 Jan. 1976 to Walker discloses a bowling scoring system wherein a central computer processes data for a plurality of terminals for an entire bowling establishment.

Despite the relative successes of these systems, they nonetheless expensive systems requiring complete integration of the system for the entire bowling establishment. Hence, they require a large capital investment by the bowling establishment. In order to justify the cost of such systems, these establishments must then charge higher usage fees which makes them less competitive for consumers' recreational dollars.

Accordingly, there remains a need for a relatively inexpensive yet automatic, electronic bowling scoring apparatus that is a portable discrete unit eliminating the need for integration of a plurality of units within a complete scoring system. There is a further need for an automatic scoring apparatus that may be phased into an existing bowling establishment without requiring substantial capital expenditures and which capital expenditures can be recaptured by methods other than a substantial increase in usage fees. There is a further need for an electronic apparatus that is portable and which complies with all bowling federation requirements.

SUMMARY OF THE INVENTION

It is an object of the present invention to provide a novel and useful scoring apparatus for bowling employing a novel display which apparatus is compact and self-contained so that it may be portable.

It is another object of the present invention to provide an electronic scoring apparatus for bowling which is reliable in construction, yet inexpensive in cost.

It is yet another object of the present invention to provide a compact, portable scoring apparatus that may be owned by an individual player or may be provided by the bowling establishment at a nominal rate.

It is still a further object of the present invention to provide an electronic scoring apparatus for bowling that is self-contained as a discrete unit so that a plurality of units may be employed by a bowling establishment to replace the existing manual score sheet system without requiring the bowling establishment to incur substantial capital expenditures.

In order to accomplish these objects, the present invention provides a microprocessor-based logic and memory circuit connected to a novel display and printer, all of which are implemented by a simplified control panel. More specifically, the main display is preferably formed as a liquid crystal display and includes a name display region comprising alpha-numeric symbols and primary frame display region and a final frame display region having numeric symbols and spare/strike symbols. This liquid crystal display being driven by a multiplexing drive circuit.

The microprocessor and memory controls the information displayed on the display, and it can be appreciated that a "running score" corresponding to a specific bowler's "bowling line" is displayed at one time. To this end, a keyboard input panel includes a scroll button connected to the microprocessor through a data multiplexer so that the microprocessor causes the display to progressively scroll through the set of bowlers whose scores are being kept by the apparatus as those scores are retained in memory. At the beginning of the scoring sequence, each bowler's name is successively entered into memory through the control panel by means of a letter scroll and a team name may optionally be entered. Once the set of bowlers has been entered, a start button is activated so that the first bowler's name appears on the primary display. As each ball is bowled, the corresponding pin fall is entered onto the display by means of numerical keys connected through the microprocessor and memory system. Control of the microprocessor is accomplished by an interface logic and control circuit. A bowler scroll button is then operated to scroll the display to the second bowler, with all of the scored information corresponding to the first bowler being retained in the memory. This process is continued until it is again the first bowler's turn. At this time, when the bowler's scroll button scrolls the display to the first bowler, all previous information for that bowler's line appears on the display as provided by memory.

The microprocessor is provided with automatic arithmetic processing to tabulate the progressive score of each bowler. The frame and ball to be scored automatically advances for each bowler, and is indexed by a curser. If, subsequent to scoring a particular frame, an error is noticed, a cursor control button may be used to move the cursor back to that frame and ball wherein the error occurred, and the error corrected by activating an error key and then inserting the correct data. The microprocessor will then automatically recalculate the arithmetic scores for successive frames and correct this information throughout the bowling line. The cursor may then be moved back to the next sequential frame and ball.

By entering team names, data necessary to comply with league rules may be maintained by the system and subsequently all desired information may be reproduced in "hard copy" form. To this end, the apparatus may be provided with a printer, such as a dot-matrix printer, a cassette tape data storage unit, or both. Other relevant information, such as a player's handicap, a player's average, and the like, may be entered into the system and maintained for selected display and for use by the microprocessor to automatically adjust the arithmetic scores of bowlers and teams.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

The present invention is directed to a scoring apparatus adapted for use in scoring a bowling game wherein one or more players or bowlers roll balls to knock down pins during each of the succession of frames. Typically, a game consists of ten frames with each frame comprising one or two bowled balls, depending upon the bowler's performance. If the first ball rolled by the bowler is effective in knocking over all of the target pins, the bowler is awarded a "strike" whereas if the bowler requires two balls to knock over all of the pins, the bowler is awarded a "spare". If a player achieves a "strike", that frame is over and, typically, a player may roll no more than two balls per frame except for the final frame where a "strike" or "spare" is obtained. In all other cases, a player is awarded a pinfall count according to the number of pins knocked over in each frame. If a player achieves a "strike" in addition to the ten pins knocked over, the player is also awarded, for the specific frame, those ten pins plus the total number of pins knocked over by his or her next two bowled balls. If a player achieves a "spare", in addition to the ten pins awarded for that frame, the pinfall for the next bowled ball is added to that frame as well. In the event of a "strike" or "spare" in the last frame, the bowler is awarded additional balls necessary to complete the scoring for the final frame.

Figure 1:
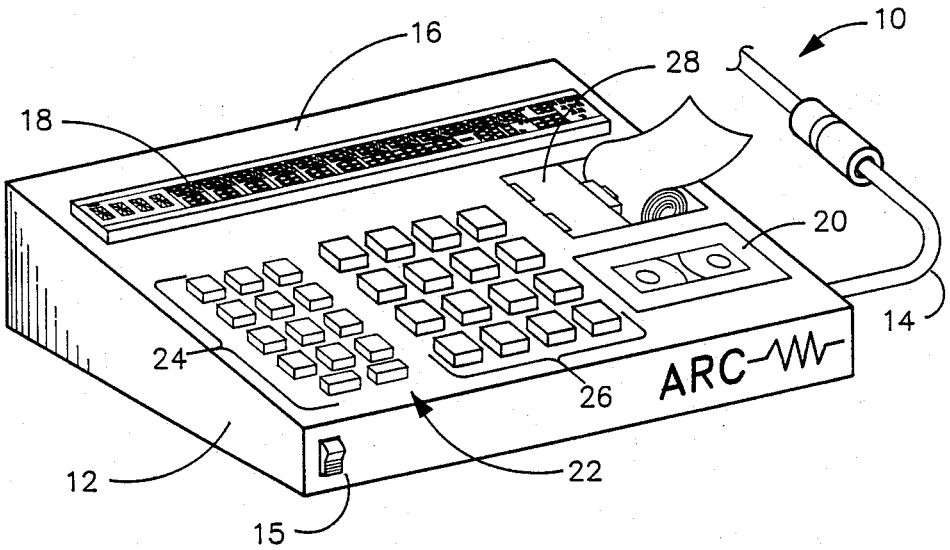
FIG. 1 is a perspective view of the bowling scoring apparatus according to the preferred embodiment of the present invention.

Due to the complexity of the scoring system, it is not uncommon for a scorekeeper to make an error in tabulating the running score of the bowlers. Accordingly, the present invention is directed to a scoring device that is simple to operate which is useful to automatically calculate the running score for one or more bowlers and to allow hard copies of the scores to be generated. As is shown in FIG. 1, the scoring device 10 according to the preferred embodiment of the present invention includes a housing structure 12 for housing the various elements of the scoring device with electrical power being provided through power line 14 controlled by "on/off" switch 15. A battery pack provides power to the device when it is not connected to an external power supply, as is known in the art. A top panel 16 of housing 12 supports, for visual observation, a display 18, best shown in FIG. 2, to allow visual monitoring of the bowler's scores. Display 18 is a specially constructed liquid crystal display for use with the circuitry of the present invention, although other digital displays, such as LEDs, are possible without departing from the scope of this invention. Panel 16 also mounts a keyboard 22 having a plurality of numeric keys 24 and a plurality of command keys 26 which permit entry of data and commands into scoring device 10. A printer 28 is received through panel 16, and may be typically a dot matrix printer for printing the information that is displayed on display 18 on command. A tape data storage unit 20 is also mounted in housing 12, as described below. While FIG. 1 shows electrical power being provided by power line 14, it should be appreciated that it is within the scope of this invention to provide electrical power by a battery pack received in housing 12 so that scoring device 10 is fully portable.

Figure 2:
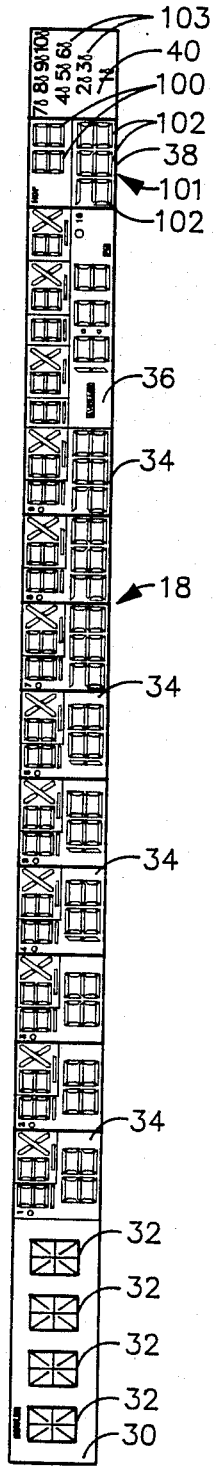
FIG. 2 is a front view in elevation of the primary display panel which is used in conjunction with the scoring apparatus shown in FIG. 1.

The novel display panel shown in FIG. 2 is constructed to allow a complete running score for a bowler to be displayed, and includes a name display region 30 having a plurality of alpha-numeric symbols 32 allowing name data identifying a bowler to be inputted so that name display region 30, when properly commanded, would display identifying data to identify a selected bowler. Display 18 has a plurality of primary frame display regions 34, with each region 34 corresponding to a frame of the bowling game. A final frame display region 36 is provided and is structured somewhat differently than primary display regions 34 to accommodate the extra balls awarded to a bowler should a bowler receive a "strike" or "spare" in the final frame. A handicap display region 38 and a standing pin display region 40 complete first display 18. The structure and function of display regions 34, 36, 38 and 40 are described more thoroughly below.

Figure 3:
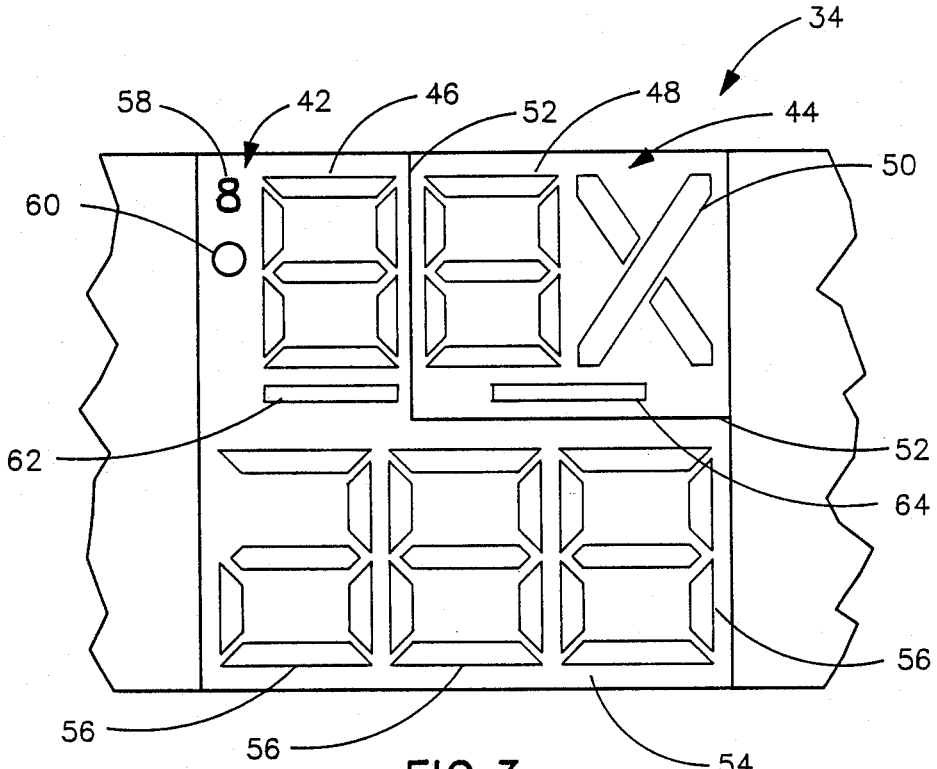
FIG. 3 is a front view of a primary frame display region of FIG. 2.

Specifically, an example of a primary frame display region 34 is shown in FIG. 3 and includes a first ball display portion 42 and a second ball display portion 44. First ball display portion 42 is defined by a variable single digit numeric symbol 46 that allows a display of an integer from 0 through 9, which corresponds to the first ball bowled for that particular frame. Should the bowler achieve a "strike" wherein all pins are knocked down, it is desirable to display the strike as a separate symbol rather than as a numeric display in the first ball display region. To this end, second ball display portion 44 includes a variable single digit numeric symbol 48 and a spare/strike symbol 50 in the form of an X-shaped symbol in the upper righthand corner of FIG. 3. For ease in viewing, a dividing line 52 separates first ball register 42 from second ball display portion 44. A subtotal ball score display portion 54 is located across the lower portion of each primary frame display region 34 and include sufficient numeric symbols to permit displaying of the maximum score achievable for a respective frame corresponding to that primary display region. Thus, the first three primary frame display regions, shown in FIG. 2, only require two numeric symbols 56 with the remaining primary display regions 34 requiring three numeric symbols 56. The second three primary display regions are designed to display any subtotal score up to 199 while the remaining primary display regions are constructed to display any score up to 399 (although a maximum score in the typical bowling game is 300).

The primary frame display region shown in FIG. 3 corresponds to the eighth frame of the display panel 18 and an index marker 58 is provided to visually indicate the frame number. Three indicating means are provided in each primary frame display region and include a frame active indicator 60 in the form of a circular dot which would be activated and deactivated to indicate that the selected frame is being addressed by the system, and ball indicators 62 and 64 in the form of small bars which may be activated and deactivated to indicate that its associated first or second ball display portion is addressable.

Figure 4:
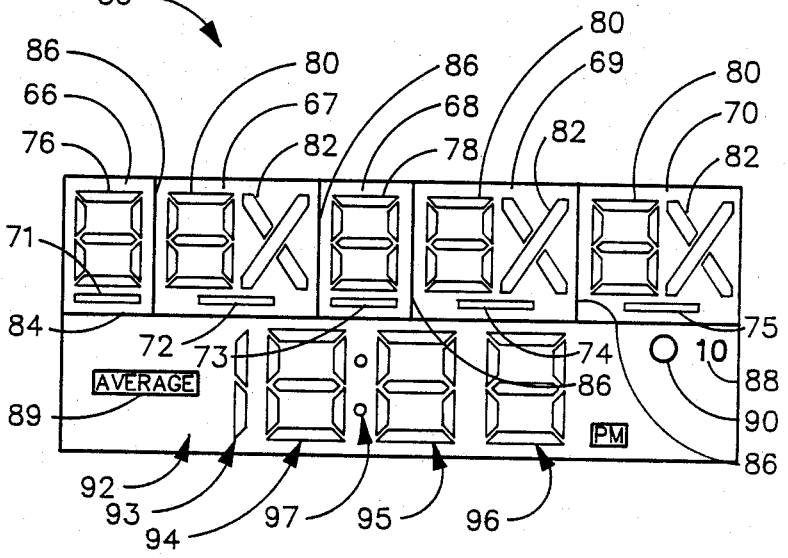
FIG. 4 is a front view in elevation of the final frame display region of the primary display shown in FIG. 2.

Final frame display region 36 is shown in FIG. 4 and is similar to the primary display frame region 34 except that means are provided to allow the displaying of all combinations of final frame scoring according to the performance of the selected bowler. To this end, final frame display region 36 includes five final ball display portions 66–70, each having ball indicators 71–75, respectively, operative to index that its associated ball display portion is addressable. Ball display portion 66 and 68 have variable single digit numeric symbols 76 and 78 while each of ball display portions 67, 69 and 70 include a variable single digit numeric symbol 80 and a spare strike symbol 82 similar to spare/strike symbols 50. Display portions 66–70 are visually separated by dividing lines 84 and 86 and the final frame is visually indexed by index marking 88. A frame active indicator 90 is switchable to indicate, when active, that the final frame is addressable by the system. A total ball score display portion 92 is defined by a clock display having numeric symbols 93 and 94 separated from numeric symbols 95 and 96 by a dual dot symbol 97. Symbols 93–96 may be used in a clock mode to display time of day, to which end a "PM" symbol 98 is selectively activated. These symbols may also be used to display the total pinfall count corresponding to the scored performance of a selected bowler or a total team score should a team name be commanded onto region 30. A bowler or team average may also be commanded and then displayed by symbols 93–96, in which case "Average" symbol 89 is active to indicate the mode of operation for display 92.

Figure 5:
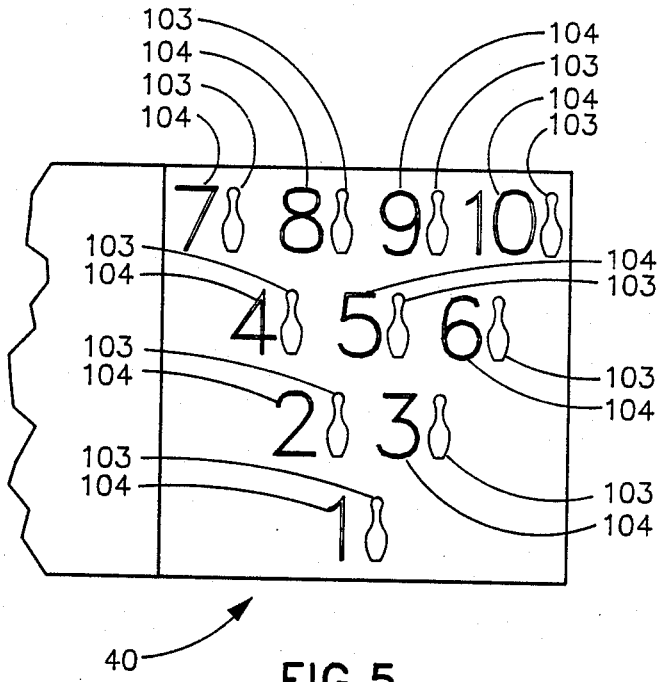
FIG. 5 is a front view in elevation of the standing pin display region of the primary display panel shown in FIG. 2.

A handicap display region 38 is shown in FIG. 2 and includes numeric symbols 100 to allow the display to show a bowler's handicap and a total score display region 101 comprised of numeric symbols 102 to allow the total score to be displayed, which total score may include an adjustment for the handicap displayed by numeric symbols 100. A standing pin display region 40, shown in FIG. 5, includes a plurality of standing pin indicators 103 that are configured in the shape of the target of bowling pins and which include numeric indicators 104. The function of standing pin display region 40 is described more thoroughly below.

Figure 6A:
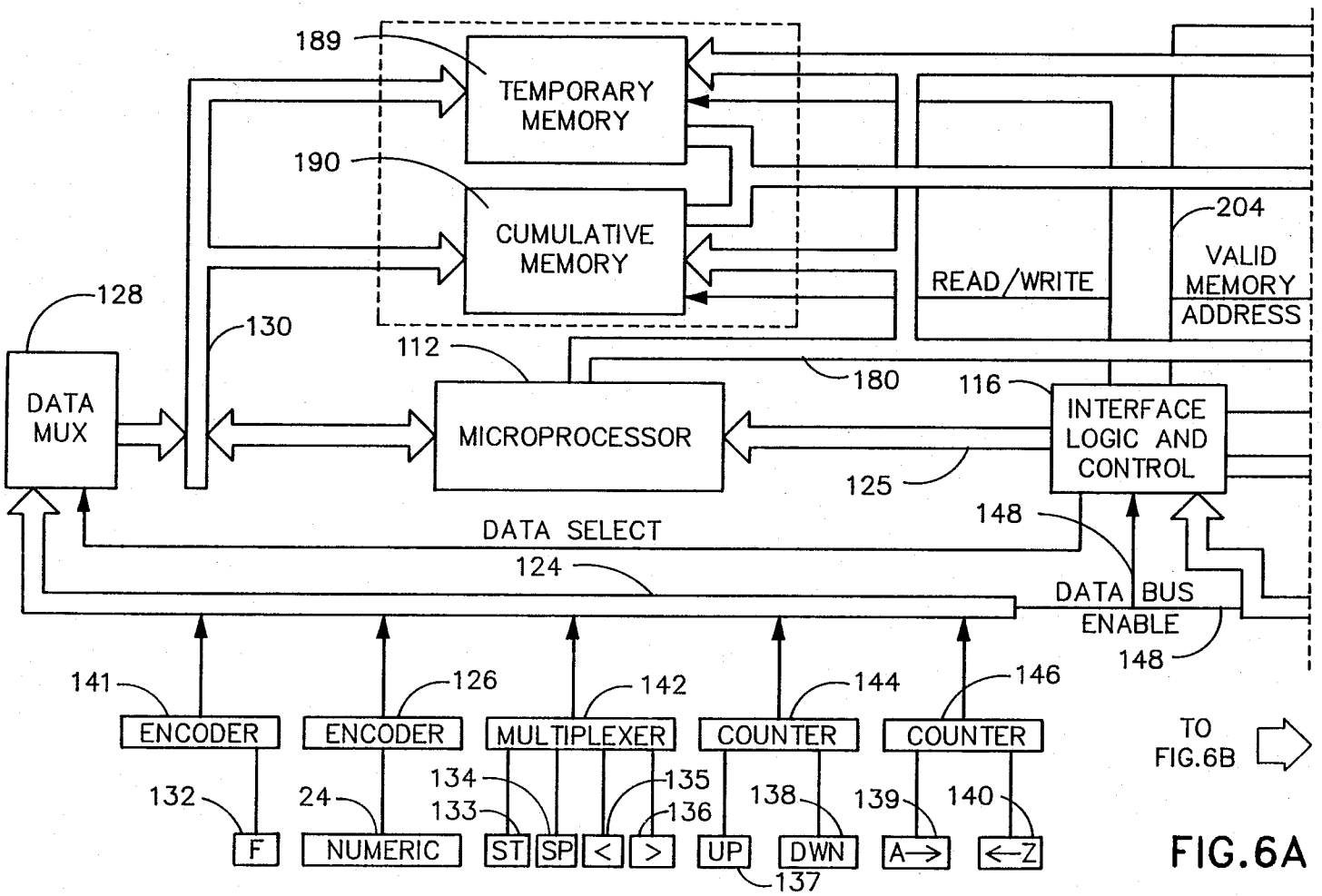
FIGS. 6A and 6B is a block diagram of the scoring apparatus shown in FIG. 1.
Figure 6B:
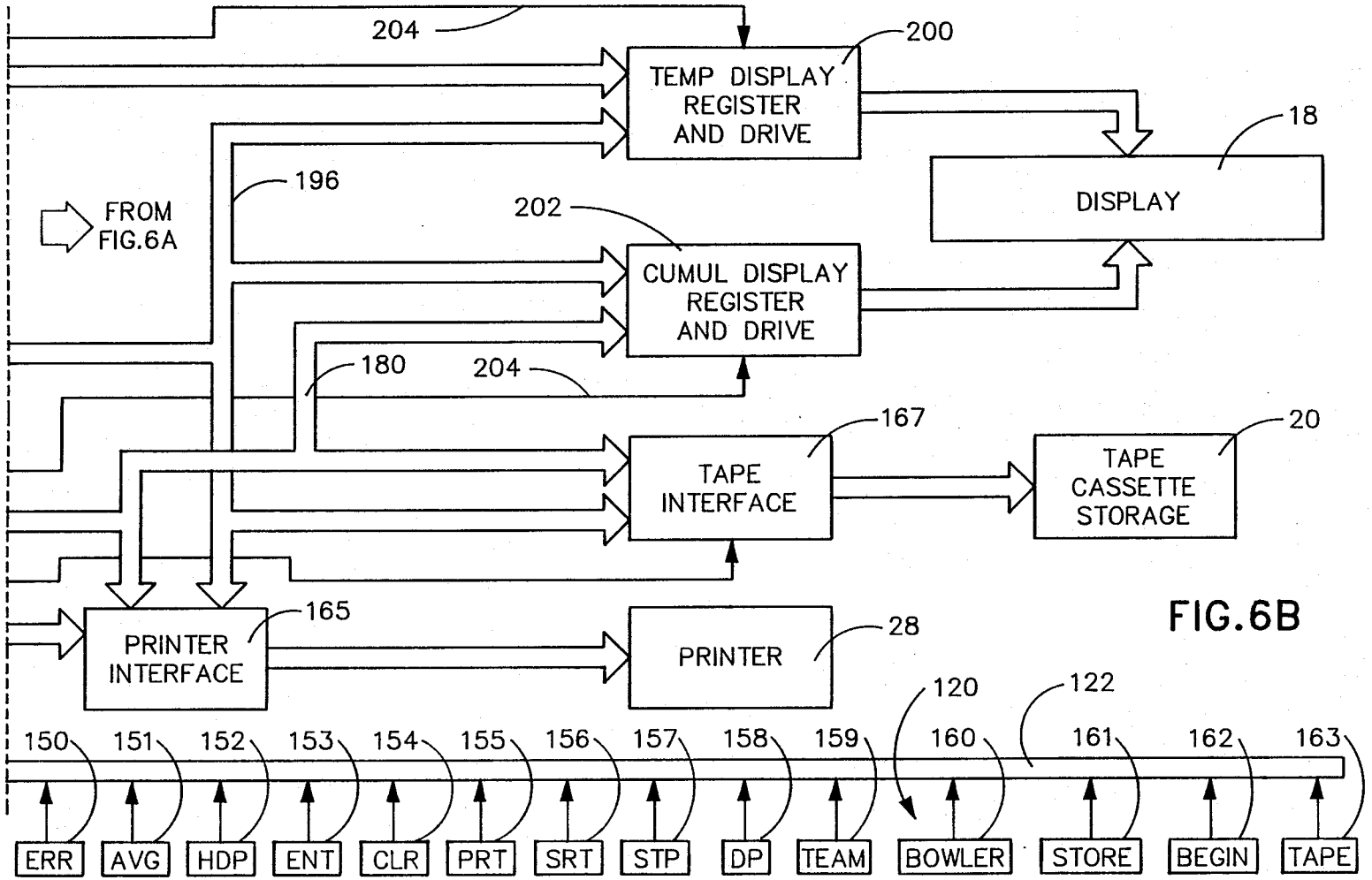

The control circuitry for scoring device 10 is diagrammed in FIGS. 6A and 6B as logic and processing circuitry 110 and includes a central processing unit in the form of microprocessor 112, a storage or memory 114 and interface logic and controls 116 which interfaces microprocessor 112, memory 114, display 18, printer 28 and tape data storage unit 20 along with keyboard 22. Thus, the display 18 may be addressed to show the running score of a selected bowler, and printer 28 and tape data storage unit 20 may be provided with score data, as well.

As is shown in FIGS. 6A and 6B, control keys 120 supply commands onto data bus 122 with the command data on bus 122 being presented to interface logic and control 116. Control keys 120 include individual command keys 150–163 described below. Numeric information is supplied to data bus 124 through encoder 126 connected to numeric keys 24, which typically include the digits zero through nine. Additional data keys include foul key 132, strike key 133, spare key 134, left cursor key 135, right cursor key 136, scroll up key 137, scroll down key 138, and alpha up scroll key 139 and alpha down scroll key 140. Data from foul key 132 is provided to data bus 124 through an encoder 141 and data from strike key 133, spare key 134, left cursor key 135 and right cursor key 136 are supplied to data bus 124 through multiplexer 142. Up/down scroll information from keys 137 and 138 are provided to data bus 124 through a counter 144 while information from right/left alpha scroll keys 139 and 140 are provided to data bus 124 through a counter 146. Data information from keys 132–140 are presented to data multiplexer 128 by bus 124 and is thus inputted to microprocessor 112 and memory 114 by data bus 130. Data bus enable 148 signals interface logic and control 116 that data entry keys 132–140 or command keys 150–163 have been depressed and that the information is present on buses 124 or 122, respectively.

While the purpose and function of keys 150–163 and keys 132–140 are set forth in greater detail below, it should be appreciated that, when data bus enable 148 is activated, interface logic and control 116 receives command instructions from data bus 122 corresponding to activation of selected control keys 120 in order to cause operations to be performed by microprocessor 112, to cause data multiplexer 128 to input data from data bus 124 onto data bus 130, to cause memory 114 to read or write data and to cause display 18 to display information from memory 114 and microprocessor 112, depending upon the command selected.

While it is believed that the operation of logic and processing circuitry 110, shown in FIG. 6, is understandable to one ordinarily skilled in the art, for the sake of explanation, it should be appreciated how the various command and data entry keys operate. Once the scoring device 10 is activated by activating on/off switch 15, "START" key 156 is pressed to clear all memories and total pinfall register 92 displays the current time which is placed in memory. Once "START" key 156 is used, it is disabled until the "STOP" key 157 is used or until the scoring device is deactivated by on/off switch 15. "TEAM" command key may be pressed after "START" to allow a first team name to be entered by using alpha scroll keys 139 and 140. Alpha scroll keys 139 and 140 cause the first one of alphanumeric symbols 32 to consecutively display letters of the alphabet. When the desired letter is reached, "ENTER" key 153 is pressed so that interface logic and control causes this symbol to be locked onto name display region 30 to enter the identity of the team. After the team name is entered, "BOWLER" command key 160 is used so that alpha scroll keys may cause a bowler's name identity or abbreviation thereof to be placed on name display region 30. Scroll down key 138 may then be activated to allow a second bowler's name data to be inputted into memory 114 and displayed 18 at name display region 30. This process is repeated for the desired number of bowlers according to the capacity of memory 114 after which start key 156 is activated. "TEAM" command key 159 may then be again activated to insert a second team's name, and the process is repeated for the bowlers corresponding to that team.

Upon the activation of "BEGIN" key 162 the initially inputted bowler's name again appears at name display region 30 and frame indicator 60 corresponding to the first frame is activated as well as ball indicator 62 corresponding to the first ball display portion 42 of the first frame. After the bowler bowls a first ball, and assuming the bowler does not get a strike, the appropriate numerical key corresponding to the pinfall is entered on the appropriate numeric key and is then displayed at first ball display portion 42. At this point, indicator 62 automatically goes to an inactive state and indicator 64 activates to indicate that the bowler is ready to bowl a second ball.

When the bowler bowls a second ball, the pinfall data is entered through numeric keys 24 so that numeric symbol 48 displays the appropriate pinfall corresponding to the number of pins knocked down by the bowler with the second ball. In the event that the bowler knocks all of the remaining pins down with the second ball, rather than inputting the pinfall data through numeric keys 24, the scorer simply hits "SPARE" key 134 which then causes spare/strike symbol 50 to display a diagonal line indicating that a spare was achieved. In the event that the bowler knocked down all of the pins with his first ball, the scorer hits "STRIKE" key 133 which automatically overrides first ball display portion 42 to cause symbol 50 to display an "X" corresponding to the achievement of a "STRIKE". If neither a strike nor a spare is registered, microprocessor 12 calculates a subtotal score and displays the same at subtotal ball score display portion 54 with symbols 56. If a strike or a spare is achieved by the bowler, no display is presented at subtotal ball score display portion 54 until the bowler rolls the consecutive number of balls necessary so that the subtotal score may be calculated for that frame, at which time, upon the input of successive pinfall information for successive balls, microprocessor 112 calculates the subtotal score for a frame in which a spare or a strike was registered.

If only one bowler is using the scoring device, entry of data into second ball display portion 44, be it numeric data or spare/strike data, the frame active indicator 60 for one frame is deactivated and the ball active indicator for the next successive frame is activated along with its associated first ball indicator 62. This process then repeats for the entire running score for the succession of frames. If more than one bowler's score is being tabulated by scoring device 10, then scroll up or scroll down keys 137, 138 may be activated so that a different bowler's name is displayed when a first bowler has finished with a particular frame. The current active frame for the successive bowler is then indicated by the appropriate indicator 60, and the process is repeated.

The scoring of the final frame, as displayed in final frame display region 36, is similar to that described with respect to a primary frame, but it should now be appreciated that additional ball display portions, such as ball display portion 66–70, are necessary for all possible combinations of balls bowled. For example, if a bowler bowls a strike in the final frame, his score needs to include two additional balls which could be both strikes as would then be displayed in display portion 69 and 70. The bowler could obtain a strike in the final frame, followed by a second strike and then a lesser number of pins so that two X-shaped displays would be provided at display portions 67 and 69 while a numeric display would then be displayed at symbol 80 of display portion 70. In the event the bowler received a strike in the final frame, but subsequently bowled less than a strike, then the numeric data would be presented at ball display portion 78 and the second ball would then be displayed either as numeric data in display portion 69, as symbol 80, or as a spare at the X-shaped symbol 82 in display portion 69. When all balls necessary for the final frame were completed, microprocessor 112 calculates a total score and the score is then displayed at total ball score display portion 92. Any adjustments for a bowler's handicap, as entered at symbols 100 in register 38, are automatically calculated by the microprocessor and the total adjusted score displayed by symbols 102 in total score display region 101.

At any time during the keeping of the running score for a particular bowler, print key 155 may be activated to cause printer 28 to produce a hard copy of the currently displayed information. To this end, an appropriate printer interface 165 receives data from memory 114 and printing instructions from microprocessor 112 and interface logic and control 116, as is known in the art. Additionally, or alternately, "TAPE" command key 161 may be employed to activate tape cassette storage 28 through interface 167 so that a taped copy of the data may be produced. The tape store of data could, of course, be an automatic function of the system, if desired.

Additional control keys, noted above, are provided to control the operation of microprocessor 112 to interface logic and control 116 so that the scoring device 10 may accurately score a bowling game. In the event that an error is made in the entry of pinfall data, "ERROR" key 150 may be pressed to halt the operation of the microprocessor and to erase the incorrect data. Should an error be noted in a frame other than the currently addressed frame, designated by frame active indicator 60, left cursor key 135 or right cursor key 136 may be activated to move frame active indicator 60 and the associated ball indicators 62 and 64 (or 71–75) to the location where the error occurred. The activation of "ERROR" key 150 then causes an erasure of the data displayed at the location designated by the ball indicator, and new data may be entered in the standard manner. Microprocessor 112 automatically updates all subsequent information, through memory 114, to recalculate subtotal scores and total scores for the associated bowler.

"FOUL" key 132 is provided in case a bowler crosses a foul line when bowling a ball. When "FOUL" key 132 is depressed, the symbol F is displayed at the corresponding ball display portion and the numerical value of 0, corresponding to no pinfall, is used in the score calculations by microprocessor 112.

"HANDICAP" key 152 may be used to input either a team's handicap or a bowler's handicap at the time the corresponding team's name or the bowler's name is being inputted into the system. Handicap data is entered through numeric keys 24 so that the handicap is displayed by numerical symbols 100 in handicap display 38. When activated, numerical data from numerical keys 24 will then be directly displayed by symbols 100 and entered into the memory so that microprocessor 112 may incorporate the handicap data into the total score display region at 101. In the alternative, a team's handicap or a bowler's handicap may automatically be calculated and displayed by depressing average key 151 after which the numerical data corresponding to a team's average or a bowler's average is inputted to a scoring device 10 by numerical keys 24. Microprocessor 112 then automatically calculates the handicap for the team or the bowler and displays the handicap at display region 38.

"CLEAR" key 154, when activated, causes the erasure of the most recent entry from the display and allows new data to be entered. "CLEAR" key 154 provides a command different from "ERROR" key 131 in that "CLEAR" key 154 allows new data to be entered only if no other entry has been made while "ERROR" key 131 allows new entries to be made even if other entries have already been made. "ENTER" key 153, when activated, latches and locks data into the microprocessor and causes the ball indicators and frame active indicators to automatically advance.

"STOP" key 157 is used to command the system to cease accepting data and is typically employed after all scoring is completed. In the event that a "STOP" key 157 is inadvertently pressed before the scoring is complete, "CLEAR" key 154 may be used to override the stop command, and the scoring may be continued.

"PIN DROP" key 158 is used in conjunction with pin drop display region 40. When "PIN DROP" key 158 is activated, the operation of numerical keys 24 will cause appropriate pin symbol 103 to be activated in display region 40. The scorer activates the appropriate numerical keys corresponding to the pins remaining after a bowler bowls his first ball. Once this data is displayed on standing pin display region 40, the "ENTER" key 153 is activated to enter this data into memory 114. At any subsequent time, the player may use cursor keys 135, 136 to move to a selected frame and the display will automatically show, in region 40, the results of the pinfall data correlated to the geometric positioning of pins that are not knocked down by the bowler's first ball for that period.

At any time during the scoring procedure, either the "TEAM" key 159 or the "TIME" key 163 may be pressed. When "TIME" key 163 is pressed, the current time is displayed as a clock readout at register 92. When the "TEAM" key 159 is used while a bowler's name is displayed and before "STOP" key 157 has been pressed, the team name corresponding to that bowler replaces the bowler's name; total ball score display portion 92 will then display that team's total average (and "AVERAGE" indicator 89 will activate) and display region 38 will display that team's total handicap. However, if "TEAM" key 159 is pressed after the "STOP" key, then register 92 displays the team's total score rather than its average.

Figure 7:
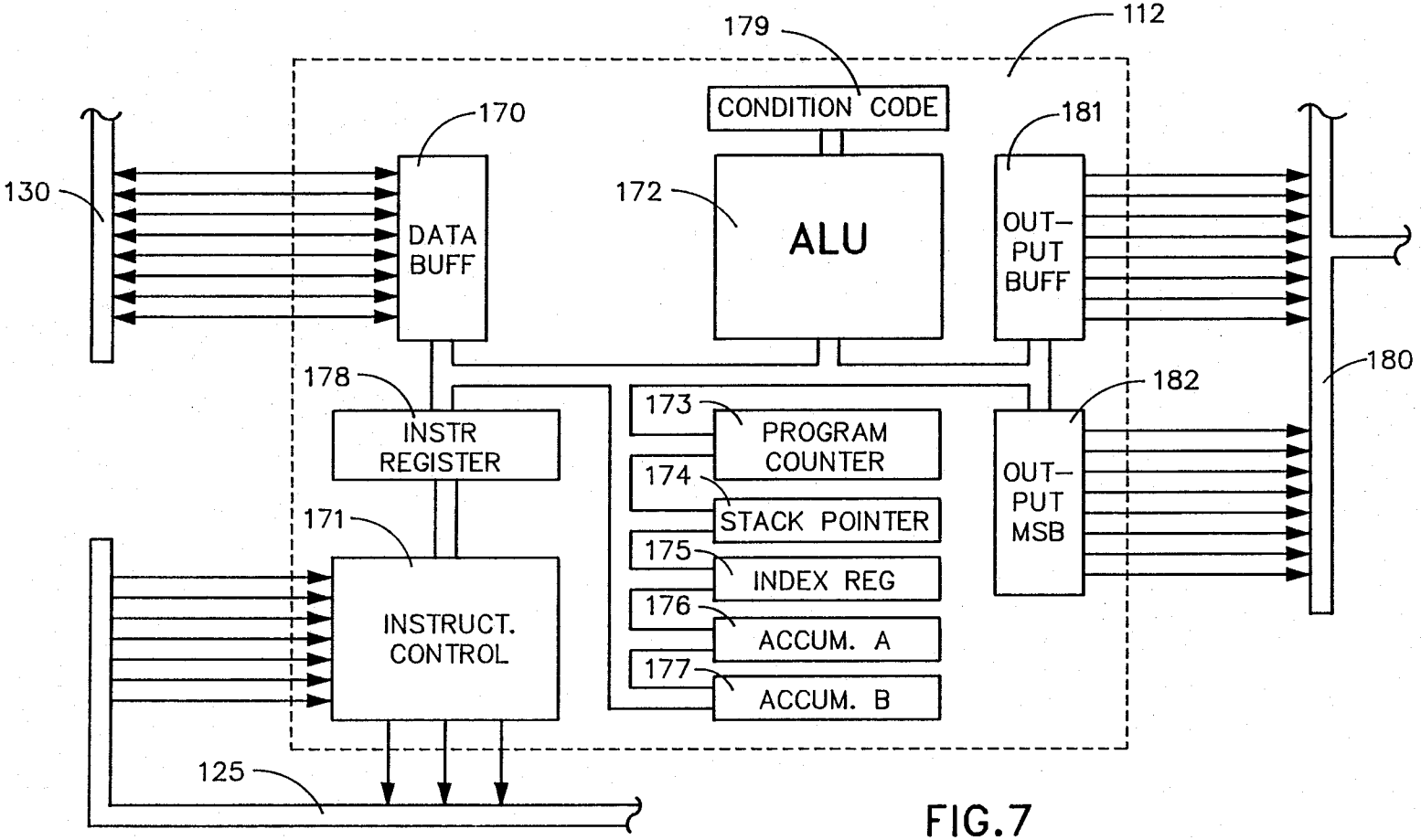
FIG. 7 is a diagram of the microprocessor circuitry shown in FIGS. 6A and 6B.

FIG. 7 shows, in diagrammatic form, the sub-elements of microprocessor 112. In FIG. 7, microprocessor 112 is shown to include a data buffer 170 for receiving data from data bus 130 and an instruction control 171 receiving instructions from interface logic and control 116 by way of command bus 125. Arithmetic logic unit 172 interfaces with program counter 173, stack pointer 174, index register 175, accumulator 176, and accumulator 177 as is known in the art. Instruction register 178 interfaces construction control 171 and ALU 172 and condition code register 179. Output from ALU 172 may be provided onto data bus 180 through outputs 181 and 182.

Figure 8:
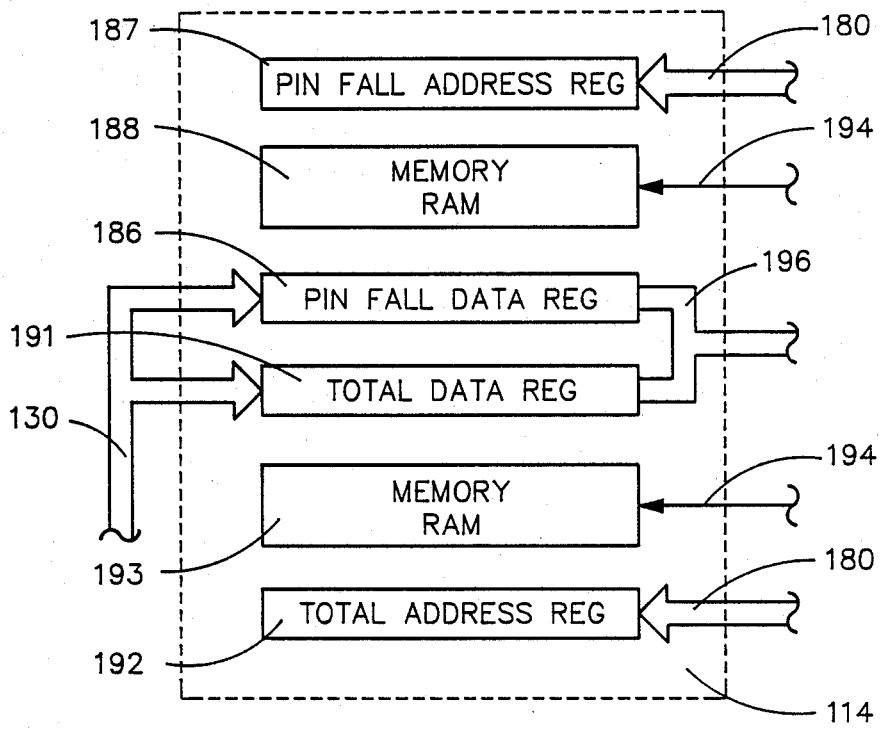
FIG. 8 is a diagram of the storage memory shown in FIGS. 6A and 6B.

Memory 114 receives data from buses 130 and 180 and outputs data on data bus 196. As is shown in FIG. 8, memory 114 is designed as a two-page memory. A first page of this memory maintains and updates current data and includes a pinfall data register 186, a pinfall address register 187 and a random access memory storage 188. Registers 186 and 187 along with RAM 188 form temporary memory 189 shown in FIG. 8. A cumulative memory 190 forms a second page and is constructed from a total data register 191, a total address register 192 and a memory RAM storage 193. Memory 114 is instructed, through bus 194 to read or write data, with these instructions coming from interface logic and control 116.

Figure 9:
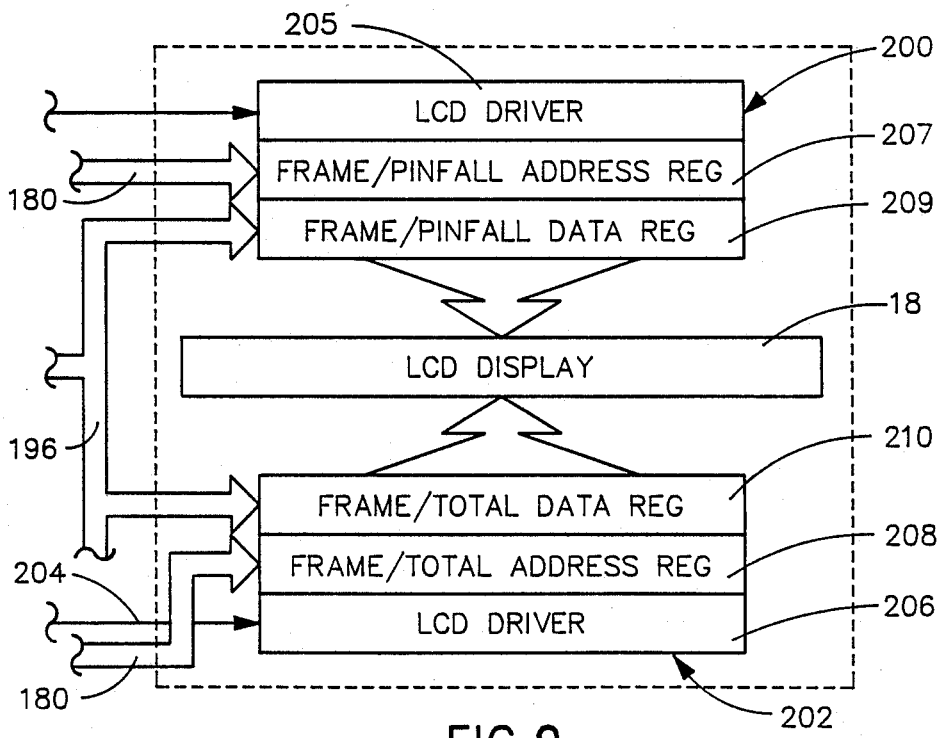
FIG. 9 is a diagram of the display panel shown in FIG. 2 along with its appropriate driving circuitry as is shown in FIGS. 6A and 6B.

As is shown in FIG. 9, LCD display 18 has a drive stage 200 for current pinfall information and a drive stage 202 for cumulative pinfall data. A valid memory bus 204 supplies a valid memory command from interface logic and control 116 to LCD drivers 205 and 206 of stages 200 and 202, respectively. Current pinfall information and cumulative pinfall information is provided by way of bus 180 to a pinfall address register 207 for drive stage 200 and to a total address register 208 for drive stage 202 Bus 196 supplies information from pinfall data register 186 and total data register 191 of memory 114 with this information being provided to pinfall data register 209 of drive stage 200 and to total data register 210 of drive stage 202. Drive stage 200 then drives the ball display portions for display 18 while drive stage 202 drives the subtotal ball score display portions, the total ball score display portion and the total score display region of display 18.

Figure 10:
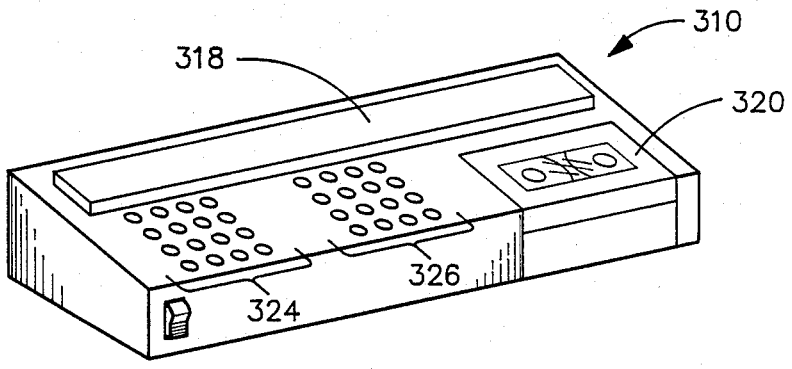
FIG. 10 is a perspective view of a first alternative embodiment of the bowling scoring apparatus according to the present invention.
Figure 11:
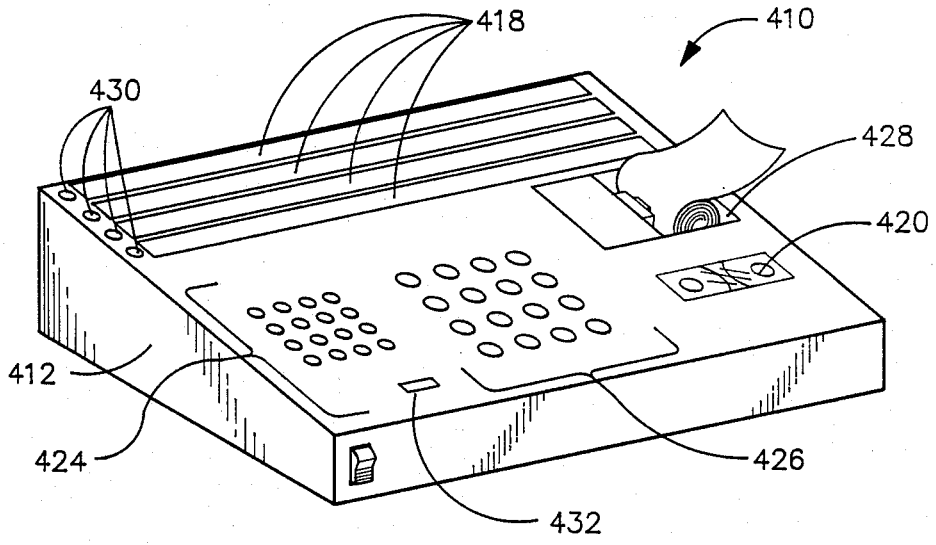
FIG. 11 is a perspective view of a second alternate embodiment of the bowling scoring apparatus according to the present invention.

FIGS. 10 and 11 show alternate embodiments of the present invention which use the same logic circuits as those described above. In FIG. 10, printer 20 is eliminated so that scoring device 310 may be more compact for easier portability. Display 318 is of the type described above, as are numeric keys 324 and command keys 326. Tape cassette 320 is provided to store the scoring data inputted into device 310. Upon completion of the scoring and as is the case with cassette storage 20, the cassette tape may be removed and placed in a remote reader/printer so that a printed copy of the scored bowling lines may be generated.

In FIG. 11, four displays 418 are mounted on housing structure 412 to construct scoring device 410. Numeric keys 424 input data to be displayed by displays 418 and command keys 426 direct operation of the microprocessor. Again, a printer 428 and a tape storage 420 are provided. The advantage of this unit is that four bowlers' line scores may be simultaneously viewed. Appropriate indicators 430 are necessary to index a specific display 418 that is to be addressed by the processing circuitry, and a display index scroll command key 432 is provided to move from one addressed display to another. The remaining aspects of the scoring are then the same as discussed above.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A scoring device adapted for use in scoring a bowling game wherein balls are bowled to knock down pins during each of a succession of frames, said scoring device for displaying the successive pin falls and for automatically calculating and displaying the running score of one or more bowlers, comprising:

a display having a plurality of sub-display regions including a name display region having alphanumeric symbols, a plurality of primary frame display regions and a final frame display region:

each said primary frame display region having a first ball display portion, a second ball display portion, a subtotal ball score display portion and a frame active indicator with said first ball display portion including a variable single digit numeric symbol and said second ball display portion including a variable single digit numeric symbol and spare/-strike symbol in the form of an X-shaped symbol:

said final frame display region having five final ball display portions with each final ball display portion including a variable single digit numeric symbol and some of said final ball display portions including a spare/strike symbol in the form of an X-shaped symbol, and having a total ball score display and a final frame active indicator;

a ball indicator corresponding to each ball display portion operative to index that its associated ball display portion is addressable;

memory means for storing name data identifying a selected person and pinfall data correlated to the selected bowler's performance for each ball bowled;

a keyboard input having identity key means for entering said name data into said memory means, pinfall key means for entering pinfall data into said memory means and command key means;

computer means for interfacing said keyboard input, said memory means and said display, said command key means for inputting command instructions into said computer means: and frame and ball display portion selecting means for causing said computer means to address a selected frame region and a selected ball display portion within said frame region whereby pinfall data may be inputted through said keyboard input and displayed at the selected ball display portion indicated by its associated said ball indicator, said keyboard input including a "spare" key means for causing the spare/strike symbol of an addressed frame region to display a line symbol for a "spare" and a "strike" key means for causing the computer means to skip the single digit numeric symbols and to cause the spare/strike symbol of an addressed frame region to display a cross symbol for a "strike" with activation of the "strike" key causing the computer means to skip the single digit numeric symbol located in the addressed frame region;

said computer means operative to cause said name display region to display said name data and whereby pinfall data is displayed for each successive frame display at its corresponding ball display portions, said computer means summing said pinfall data to display a subtotal score on a primary frame's subtotal ball score display portion and the total score on the total ball score display portion of the final frame display region, operation of the "spare" key means for an addressed primary frame display region causing the computer means to add the next entered pinfall data into the subtotal and total scores for the addressed frame display region and operation of the "strike" key means for an addressed frame display region causing the computer means to add the next two entered pinfall data into the subtotal scores for the addressed frame display region.

2. The scoring device according to claim 1 wherein a plurality of bowlers' scores are simultaneously maintained by said memory means whereby said display indicates the running score of a selected bowler and including a bowler scroll means for causing a consecutive bowler's name and running score to be displayed upon successive activations in the order that the bowlers' name data was entered into the memory means, activation of the bowler scroll means when a last entered bowler's name is displayed causing the running score of a first entered bowler's name to be displayed, said computer means operative on the displayed bowler's score while said memory means maintains data corresponding to all other bowlers' running scores.

3. The scoring device according to claim 2 including a reverse bowler scroll means for causing a preceding bowler's running score to be displayed.

4. The scoring device according to claim 1 including printer means for generating a printed copy of a bowler's running score displayed on said display and printer initiate means for activating said printer means.

5. The scoring device of claim 1 including a tape storage means for recording said name data, said pinfall data, and the scores associated therewith on a magnetic tape medium.

6. The scoring device according to claim 1 wherein said computer means includes a processing unit operative to process name data and pinfall data entered by said keyboard input and interface logic and control circuitry operative to command said processing unit to perform selected processing steps and to command said memory means to read and write data from said processing means, and including data buses interconnecting said keyboard input, said interface logic and control circuit, said processing unit, said memory means and said display.

7. The scoring device according to claim 1 wherein said memory means has data representing two primary pages including a current pinfall data page and a total pinfall data page.

8. The scoring device according to claim 1 including correction means whereby said ball indicator may be activated to address a selected ball display portion preceding the last ball display portion of said running score whereby said data displayed at the selected ball display portion may be altered to correct an error in data entry, said computer means operative to automatically update and correct all total and total scores according to a change in the data entry for the selected ball display portion.

9. The scoring device according to claim 1 wherein said identity key means includes right and left alphabet scroll keys.

10. The scoring device according to claim 1 wherein said display has a handicap display region and means for entering numerical handicap data into said memory means for display at said handicap display region, said computer means using said numerical handicap data in calculating a bowler's total score.

11. The scoring device according to claim 1 wherein said display has a standing pin display region representative of the configuration of the pins to be knocked down and means for causing said standing pin display region to display a configuration of remaining pins not knocked down after a selected bowled ball in a selected frame, said memory means retaining data corresponding to the configuration of the remaining pins whereby the standing pin display region will display such configuration for a selected frame when the frame and ball selecting means addresses the selected frame region.

12. A scoring device adapted for use in scoring a bowling game wherein balls are bowled to knock down pins during each of a succession of frames, said scoring device for displaying the successive pin falls and for automatically calculating and displaying the running score of one or more bowlers, comprising:

a display having a plurality of sub-display regions including a name display region having alphanumeric symbols, a plurality of primary frame display regions and a final frame display region;

each said primary frame display region having a first ball display portion, a second ball display portion, a subtotal ball score display portion and a frame active indicator with said first ball display portion including a variable single digit numeric symbol and said second ball display portion including a variable single digit numeric symbol and spare/-strike symbol in the form of an X-shaped symbol;

said final frame display region having a plurality of final ball display portions with each final ball display portion including a variable single digit numeric symbol and some of said final ball display portions including a spare/symbol in the form of an X-shaped symbol, and having a total ball score display portion and a final frame active indicator:

a ball indicator corresponding to each ball display portion operative to index that its associated ball display portion is addressable;

memory means for storing name data identifying a selected person and pinfall data correlated to the selected bowler's performance for each ball bowled;

a keyboard input having identity key means for entering said name data into said memory means, pinfall key means for entering pinfall data into said memory means and command key means:

computer means for interfacing said keyboard input, said memory means and said display, said command means for inputting command instructions into said computer means, and including a START key means for clearing the memory means in order that new data may be inputted into the memory means, and a STOP key means for inhibiting data input into the memory means, and a CLEAR key means for eliminating a most recently entered data: and frame and ball display portion selecting means for causing said computer means to address a selected frame region and a selected ball display portion within said frame region whereby pinfall data may be inputted through said keyboard input and displayed at the selected ball display portion indicated by its associated said ball indicator, said keyboard input including a "spare" key means for causing the spare/strike symbol of an addressed frame region to display a line symbol for a "spare" and a "strike" key means for causing the computer means to skip the single digit numeric symbols and to cause the spare/strike symbol of an addressed frame region to display a cross symbol for a "strike" with activation of the "strike" key causing the computer means to skip the single digit numeric symbol located in the addressed frame region:

said computer means operative to cause said name display region to display said name data and whereby pinfall data is displayed for each successive frame display region at its corresponding ball display portions, said computer means summing said pinfall data to display a subtotal score on a primary frame's subtotal ball score display portion and the total ball score display portion of the final frame display region, operation of the "spare" key means for an addressed primary frame display region causing the computer means to add the next entered pinfall data into the subtotal and total scores for the addressed frame display region and operation of the "strike" key means for an addressed frame display region causing the computer means to add the next two entered pinfall data into the subtotal scores for the addressed frame display region.

13. A scoring device according to claim 12 wherein a first activation of said START key means inhibits subsequent activation of said START key means until said STOP key means is activated.

14. The scoring device according to claim 12 wherein a plurality of bowler's scores are simultaneously maintained by said memory means whereby said display indicates the running score of a selected bowler and including up/down bowler scroll means for respectively causing a preceding bowler's name and running score to be displayed upon activation in an "up" mode and a succeeding bowler's name and running score to be displayed upon activation in a "down" mode, each scroll being in the order that the bowlers' name data was entered into the memory means, activation of the bowler scroll means in a "down" mode when a last entered bowler's name is displayed causing the running score of a first entered bowler's name to be displayed and activation of the bowler scroll means in a "up" mode when the first entered bowler's name is displayed causing the running score of the last entered bowler's name to be displayed, said computer means operative on the displayed bowler's score while said memory means maintains data corresponding to all other bowlers' running scores.

15. The scoring device according to claim 12 including a tape storage means for magnetically recording said name data, said pinfall data and the running scores of the bowlers on a magnetic tape medium.

16. The scoring device according to claim 15 wherein said command key means includes a TAPE key means for selectively activating said tape storage means.

17. The scoring device according to claim 12 including printer means for generating a printed copy of a bowler's running score displayed on said display and printer initiate means for activating said printer means.

18. The scoring device according to claim 12 wherein said computer means includes a "time of day" clock, said total ball score display portion defined by hour/minute digits, and said command key means including a TIME key operative upon activation to cause said total ball score display portion to display the time of day.

19. The scoring device of claim 12 wherein said command key means includes a TEAM key means for permitting entry of team identity data into said memory means and a BOWLER key means for permitting entry of said name data in a manner whereby the name data may be correlated to the team identity data.

20. The scoring device of claim 19 wherein said computer means is operative upon activation of said TEAM key means subsequent to the activation of said START key means to cause said total ball score display portion to display a subtotal sum score of all bowlers correlated to a selected team identity.

21. The scoring device according to claim 20 wherein said display having a handicap display region and means for entering numerical handicap data into said memory means for display at said handicap display region, said computer means using said numerical handicap data in calculating a bowler's total score and, upon activation of said TEAM key means subsequently to the activation of the START key means, to cause said handicap display region to display a summed total of all handicaps of the bowlers correlated to the selected team identity.

22. The scoring device according to claim 12 including correction means whereby said ball indicator may be activated to address a selected ball display portion preceding the last ball display portion of said running score whereby said data displayed at the selected ball display portion may be altered to correct an error in data entry, said computer means operative to automatically update and correct all subtotal and total scores according to a change in the data entry for the selected ball display portion.

23. The scoring device according to claim 12 including a FOUL key operative upon activation to display the letter "F" in an addressed ball display portion.

* * * * *